United States Patent [19]

Lindahl

[11] Patent Number: 4,615,081

[45] Date of Patent: Oct. 7, 1986

[54] ATTACHMENT DEVICE

[75] Inventor: Per-Olof Lindahl, Västra Frölunda, Sweden

[73] Assignee: AB Fixfabriken, Gothenborg, Sweden

[21] Appl. No.: 616,136

[22] Filed: Jun. 1, 1984

[30] Foreign Application Priority Data

Jun. 2, 1983 [SE] Sweden ..... 8303123

[51] Int. Cl.[4] ..... A44B 1/00

[52] U.S. Cl. ..... 24/90 R; 24/322; 24/614; 24/698

[58] Field of Search ..... 24/265 R, 265 BC, 265 EC, 24/265 H, 90 R, 102 R, 102 A, 102 E, 102 FC, 102 P, 698, 699, 659, 598, 599, 600, 72.7, 150 FP, 41, 322, 342, 700, 701, 43, 47, 367, 378, 379, 614; D2/405, 409, 422, 442, 444, 449

[56] References Cited

U.S. PATENT DOCUMENTS

| | | | |
|---|---|---|---|
| 344,313 | 6/1886 | Gutmann | 24/102 P |
| 376,457 | 1/1888 | Walters | 24/41 |
| 1,042,601 | 10/1912 | Rasch | 24/698 |
| 1,106,653 | 8/1914 | Hollingsworth | 24/41 X |
| 1,199,707 | 9/1916 | Mitchell et al. | 24/102 P |
| 1,212,667 | 1/1917 | Orpin | 24/102 P |
| 1,352,095 | 9/1920 | Smith | 24/102 P |
| 1,803,214 | 4/1931 | Siegel | 24/659 X |
| 3,529,329 | 9/1970 | Burleson . | |
| 4,347,932 | 9/1982 | Furutu | 24/72.7 X |

FOREIGN PATENT DOCUMENTS

| | | | |
|---|---|---|---|
| 294533 | 10/1916 | Fed. Rep. of Germany | 24/698 |
| 1805474 | 1/1978 | Fed. Rep. of Germany . | |
| 2003459 | 11/1969 | France . | |
| 74807 | 9/1917 | Switzerland | 24/41 |

*Primary Examiner*—William E. Lyddane
*Assistant Examiner*—James R. Brittain
*Attorney, Agent, or Firm*—Hill, Van Santen, Steadman & Simpson

[57] ABSTRACT

A device for mounting the attachment part of an element, for instance a button, buckle, clamp, etc., into an opening, preferably a slot shaped opening of the button hole type in a piece of garment.

The attachment part is formed with a neck dimensioned for being tightly encompassed by the opening in the operative position of the neck. A disc shaped fixing member of the attachment part is arranged for being placed inside the opening. An angled slot is formed in the disc shaped fixing member and at the bottom thereof there is a distance across the fixing member which is to an external end point of said member at a maximum equal to the length of the opening, between the area of contact of the bottom against the edge of the opening and the area where the external end point passes the opening.

2 Claims, 10 Drawing Figures

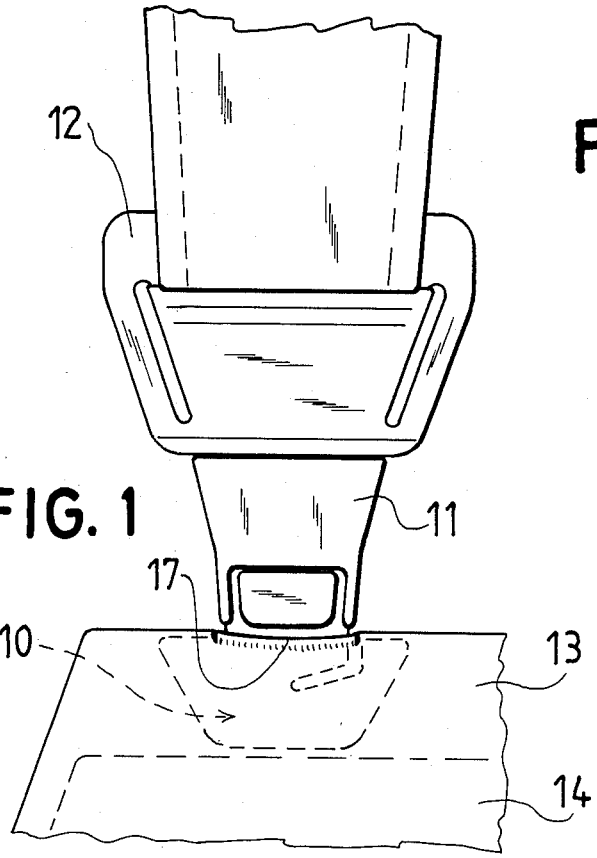
FIG. 1
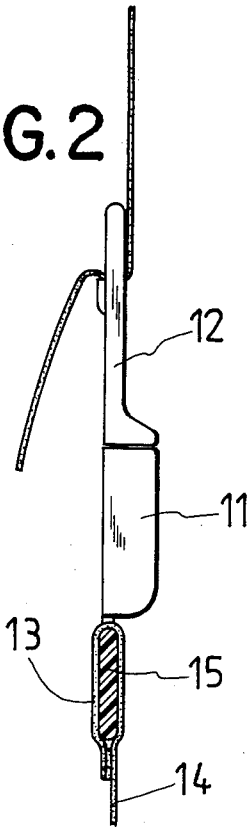
FIG. 2
FIG. 3
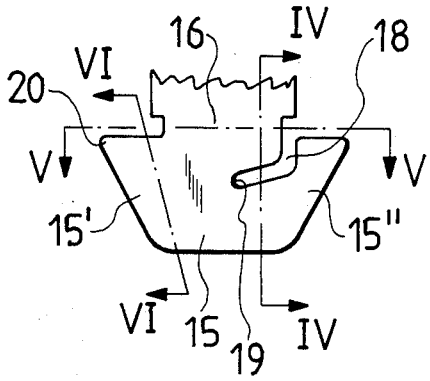
FIG. 6
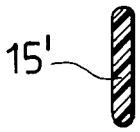
FIG. 4
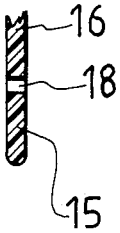
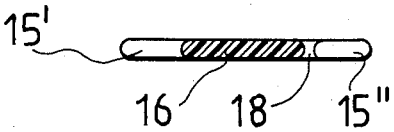
FIG. 5

FIG. 7
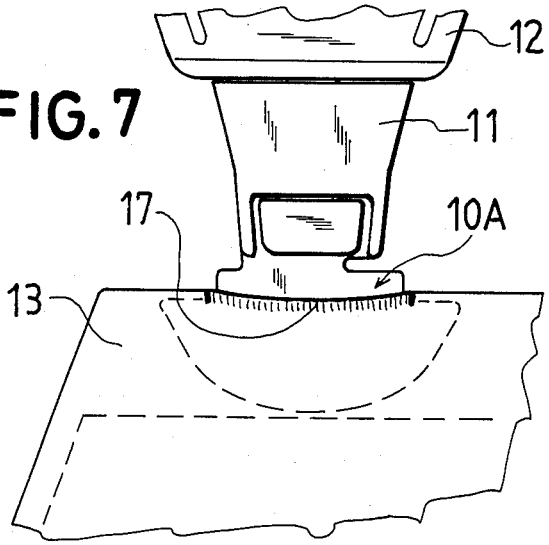
FIG. 8
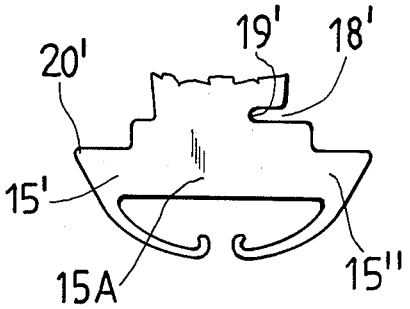
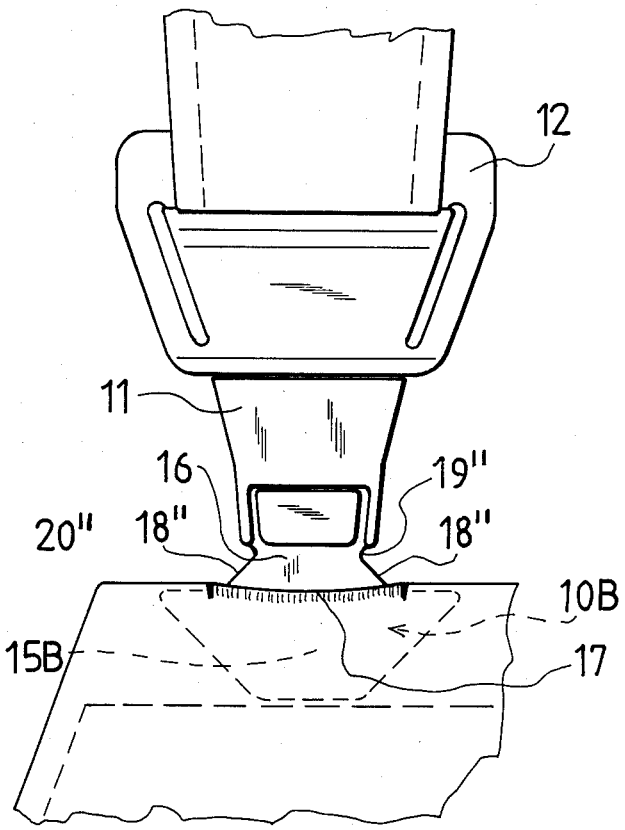
FIG. 9
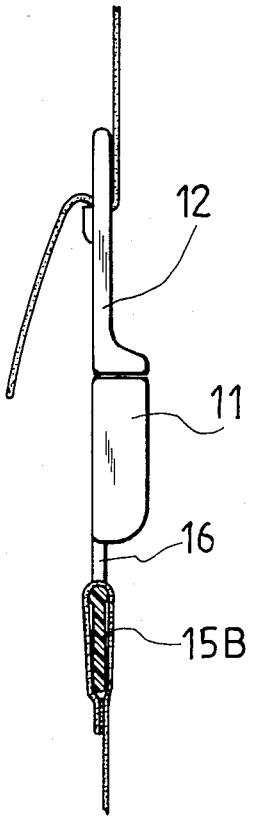
FIG. 10

ATTACHMENT DEVICE

FIELD OF THE INVENTION

The present invention relates to a device for mounting the attachment part of a fastener, for instance a button, part of a buckle, clamp, etc., in an opening, preferably a slot shaped opening of the button hole type in a piece of garment.

BACKGROUND OF THE INVENTION

The problem behind the invention is to provide a device having a broad field of use and which does not require tools/machinery for the mounting and replacement thereof, but still offers a good attachment without any risk for unintentional release of the attachment part.

The most common way to attach a buckle or a part of a buckle or similar element to a piece of garment, is to sew a strip having a buckle threaded into the strip onto the piece of garment, or to rivet or sew a buckle to a strip already attached to the piece of garment. The rivetting method requires special machinery for practical production, machinery which will be found rarely in a garment manufacturing industry. The cost of machinery is high and the method of using a strip of material as an intermediate part between the buckle and the piece of garment implies an additional process step.

SUMMARY OF THE INVENTION

The device according to the invention is intended for obviating said drawbacks, partly due to the fact that the attachment of the device does not require other machinery than the machinery usually found in a garment manufacturing facility (for instance machinery for sewing button holes), partly due to the fact that no time consuming additional processing steps are required. The arrangement according to the invention is based on the fact that the device has an fixing member which in the preferred embodiment is attached simply in a button hole or similar opening in a piece of garment, for instance in the actual folded edge of a hem.

The invention comprises an attachment portion provided with a neck of an operative dimension such that at least part thereof is encompassed tightly by the opening, a plate-shaped fixing member integral with the attachment portion and arranged for being placed inside the opening, and a contact portion on the attachment portion for initially contacting the edge of the opening during the mounting, the contact portion having such an extent that at least at one point along the extent thereof there is a distance, across the fixing member to an external end point of the fixing member, at a maximum equal to the distance across the opening, measured between the abutment area of the first point against the edge of the opening and the area where the external end point passes the opening.

In a preferred embodiment the contact portion initially contacting the edge of the opening comprises the end of a slot in the plate-shaped fixing member of the mounting device.

The distance from the bottom of the slot to the external end point preferably at a maximum equals said distance across the opening.

In one embodiment the opening has the shape of an elongated opening, for instance of the button hole type, for receiving the plate-shaped fixing member, the plane of which is oriented generally parallel to the portion of the neck to be placed in the opening. The size of the fixing member in the transition area between the neck and the fixing member is substantially larger than the size of the neck, and the slot is shaped as an angled slot which opens at the edge of the fixing member close to the neck.

In an alternative embodiment the contact portion initially contacting the edge of the opening comprises a pair of external surfaces of the fixing member having a generally linear extent and converging towards the end of the attachment part remotely from the plate-shaped fixing member.

In another embodiment the contact portion initially contacting the edge of the opening is formed as an opening at the end of the neck remote from the fixing member.

BRIEF DESCRIPTION OF THE DRAWINGS

FIG. 1 is a basic diagram showing a first type of fixing member inserted into a hem and connected to a hanger band strip (buckle);

FIG. 2 is a side view partly in section of the arrangement in FIG. 1;

FIG. 3 is a partial view of the attachment part;

FIGS. 4 to 6 are sections along corresponding lines IV—IV, V—V and VI—VI, respectively, in FIG. 3;

FIG. 7 is a basic diagram showing another type of arrangement;

FIG. 8 is a partial view of FIG. 7;

FIG. 9 is a basic diagram showing still a further type of arrangement; and

FIG. 10 is a side view, partly in section, of the arrangement in FIG. 9.

DESCRIPTION OF PREFERRED EMBODIMENTS

In FIG. 1 the mounting device 10 is formed integral with a sleeve 11 of a fastener, in which a hanger belt buckle (clamp) 12 is attached. A portion of the mounting device is placed and trapped in a hem 13 on the breast portion 14 of a bib type of trousers. The mounting device 10 basically comprises an attachment portion integral with the sleeve 11, an anchor shaped, plate-like fixing member 15 (FIG. 3) having two wings 15', 15'' and a neck 16 on the attachment portion. The dimensioning of the neck is such that the neck will be tightly encompassed by the edges 17 of the garment opening in which the neck is inserted. These edges 17 are preferably sewed edges which are sewed in a button hole manner. The length of the "button hole" equals approximately the extent of the neck 16 in the plane shown in Fig. 3.

In the wing 15' there is formed an angled slot 18 which has the mouth thereof close to the neck 16. The distance from the bottom 19 of the slot to the external end point or peak 20 of the oppositely located wing 15' at a maximum equals the length of the hole 17.

The mounting of the attachment part into the opening of the hem is carried out such that the edge of the opening 17 is placed in the slot 18 the end 19 of which will serve as a guide, preferably by first inserting the wing 15'' into the opening, whereafter the slot 18 is placed around the edge of the opening, such that the edge abuts the bottom of the slot 18. By rotation of the mounting device 10 in a direction towards the slot shaped opening and in the same orientation as this opening, the peak 15' will enter the opening freely. Thereafter the edge 17 is withdrawn from the slot 18, and the placement of the fixing member 15 inside the opening has now been finished.

Regardless of any later rotation of the attachment part, the edge of the button hole will not enter into the slot sufficiently deep to release the fixing member 15 from the hem.

In the embodiment according to FIGS. 7 and 8, the mounting device 10A has a fixing member 15A also having wings 15' and 15'', the wing 15' having an opening or slot 18' instead of the slot 18 in FIG. 3. The inner corner 19' of the opening is located at a distance from the corner 20' at a maximum equal to the length of the hole/slot 17. Basically, the same mounting procedure as described previously is used in this embodiment. The fixing member 15A is terminated by a pair of spring support legs 21, 21, which in the mounted position of the mounting device 10A lift the fixing member to a position where there is no risk for the edge of the hole slot 17 to enter the slot 18', thereby avoiding release of the fixing member from the hem.

A further embodiment is shown in FIGS. 9 and 10, where the neck 16 has a pair of side surfaces 18'' converging upwardly and away fixing member 15B equivalent to the slot 18 and opening 18', respectively, and each side surface/edge forms a portion initially contacting the edge of the opening when installing the mounting device. The distance from the point 19'' to the peak/external end point 20'' thus at a maximum equals the length of the hole/slot 17. The neck 16 is brought into abutment against the edge of the opening and when the point 19'' has been reached, the mounting device 10B is rotated around said point in a plane in register with the slot 17 and into this slot. Thereafter the mounting device is returned to a position according to FIG. 9. In the embodiment according to FIGS. 9 and 10 there may also be included "spring legs" according to FIG. 8.

Further variations and alternatives are possible within the scope of the claims. Thus, there may for instance be arranged slots at both sides of the fixing member, in positions that may vary along the attachment part/neck.

I claim:

1. A fastener having a mounting device receptive into a slot-shaped opening of predetermined length in a piece of garment, said device comprising:

(a) an attachment portion secured to the fastener and having a neck portion of plate-shaped configuration and of a dimension such that it is tightly surrounded by the margins of the slot-shaped opening when the attachment portion is in an operative position with said neck-portion disposed in said slot-shaped opening;

(b) a fixing member integral with said attachment portion and of plate-shaped configuration generally coplanar with the neck portion and of a length in a direction cross-wise of said neck longer than the length of the slot-shaped opening and defining wings for projecting beyond both ends thereof; and (c) a slot in one of said wings extending from the edge of the wing adjacent to said neck portion into said one wing, and angled toward the other of said wings, whereby both wings and the open end of said slot, in the operative position of said attachment portion, would extend beyond the slot-shaped opening in the garment, the inner end of said slot being a contact portion on an edge of said fixing member and being a guide for engaging an end of the slot-shaped opening, said contact portion being engageable with the end of the slot-shaped opening during insertion of said fixing member into the slot-shaped opening, said fixing member having such an extent that at least at one point along said contact portion there is a distance between said one point and an extreme end point of said other wing which, at a maximum, is equal to the length of the slot-shaped opening, whereby said fixing member is placeable through the margins of the slot-shaped opening by a rotational movement of said fixing member in its one single plane.

2. A fastener having a mounting device receptive into a slot-shaped opening of predetermined length in a piece of garment, said device comprising:

(a) an attachment portion secured to the fastener and having a neck portion of plate-shaped configuration and of a dimension such that it is tightly surrounded by the margins of the slot-shaped opening when the attachment portion is in an operative position with said neck-portion disposed in said slot-shaped opening;

(b) a fixing member integral with said attachment portion and of plate-shaped configuration generally coplanar with the neck portion and of a length in a direction cross-wise of said neck longer than the length of the slot-shaped opening for projecting beyond both ends thereof;

(c) a contact portion on an edge of one of said plate-shaped attachment portion and said fixing member and being a guide for engaging an end of the slot-shaped opening, said contact portion being engageable with the end of the slot-shaped opening during insertion of said fixing member into the slot-shaped opening, said fixing member having such an extent that at least at one point along said contact portion there is a distance between said one point and an extreme end point of said fixing member which, at a maximum, is equal to the length of the slot-shaped opening, whereby said fixing member is placeable through the margins of the slot-shaped opening by a rotational movement of said fixing member in its one single plane; and (d) said fixing member having a pair of oppositely directed wings for projecting beyond the ends of the slot-shaped opening, each of said wings having a resilient support leg extending from the distal end of the wing toward the other support leg.

* * * * *